US009265981B2

(12) United States Patent
Orr et al.

(10) Patent No.: US 9,265,981 B2
(45) Date of Patent: Feb. 23, 2016

(54) PIP CAP ASSEMBLY FOR A FIRE PROTECTION SPRINKLER

(71) Applicant: The Viking Corporation, Hastings, MI (US)

(72) Inventors: Shawn G. Orr, Grand Rapids, MI (US); David Vaneerden, Middleville, MI (US)

(73) Assignee: The Viking Corporation, Hastings, MI (US)

( * ) Notice: Subject to any disclaimer, the term of this patent is extended or adjusted under 35 U.S.C. 154(b) by 506 days.

(21) Appl. No.: 13/711,992

(22) Filed: Dec. 12, 2012

(65) Prior Publication Data

US 2014/0158381 A1 Jun. 12, 2014

(51) Int. Cl.

| | |
|---|---|
| ***A62C 37/12*** | (2006.01) |
| ***A62C 37/14*** | (2006.01) |
| ***A62C 37/11*** | (2006.01) |

(52) U.S. Cl.

CPC ..... *A62C 37/14* (2013.01); *A62C 37/11* (2013.01)

(58) Field of Classification Search

CPC ..... A62C 37/12; A62C 37/11; A62C 37/14
USPC ..... 169/37, 42
See application file for complete search history.

(56) References Cited

U.S. PATENT DOCUMENTS

| | | | |
|---|---|---|---|
| 2,370,243 | A | 2/1945 | Henshaw |
| 3,663,720 | A | 5/1972 | Thompson |
| 4,109,727 | A | 8/1978 | Job et al. |
| 4,217,961 | A | 8/1980 | Wotton |
| 4,991,656 | A | 2/1991 | Polan |
| 5,020,601 | A | 6/1991 | Retzloff et al. |
| 5,299,645 | A | 4/1994 | Hoening et al. |
| 5,494,114 | A | 2/1996 | Hoening et al. |
| 5,713,524 | A | 2/1998 | Greene et al. |
| 5,810,263 | A | 9/1998 | Tramm |
| 5,967,238 | A | 10/1999 | Pepi et al. |
| 6,276,460 | B1 | 8/2001 | Pahila |
| 6,854,668 | B2 | 2/2005 | Wancho et al. |
| 6,868,916 | B2 | 3/2005 | Petersen |
| 7,314,093 | B2 | 1/2008 | Orr |
| 7,353,882 | B2 | 4/2008 | Pahila |
| 7,735,569 | B2 | 6/2010 | Green |
| 2005/0081380 | A1 | 4/2005 | Knoblauch |
| 2007/0007018 | A1 | 1/2007 | Kong |
| 2009/0294140 | A1 * | 12/2009 | Green ..... 169/38 |

* cited by examiner

*Primary Examiner* — Arthur O Hall
*Assistant Examiner* — Viet Le
(74) *Attorney, Agent, or Firm* — Harness, Dickey & Pierce, P.L.C.

(57) ABSTRACT

A sprinkler assembly includes a sprinkler body having a base and a frame extending from the base. The base has a passage extending therethrough defining an inlet and an outlet. A deflector is mounted to the frame and spaced from the outlet, which is configured to deflect fluid flowing from the outlet in a radial pattern. A trigger assembly extends between the frame and the base and is adapted to support a pip cap assembly in the outlet and release the plug when a temperature associated with a fire condition is detected. The pip cap assembly includes a copper shell and a stainless steel insert received in the copper shell and extending outward therefrom.

8 Claims, 2 Drawing Sheets

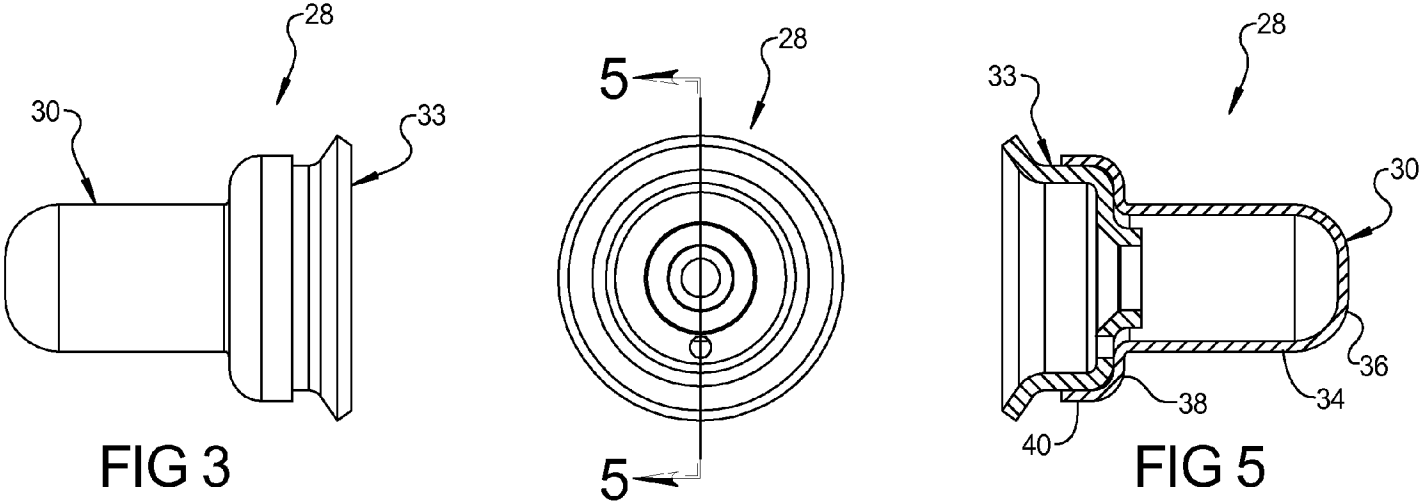
FIG 3
FIG 4
FIG 5
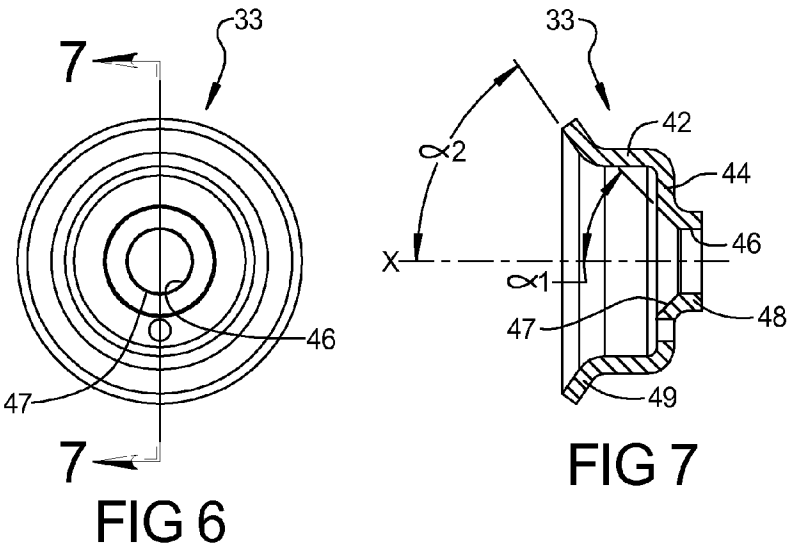
FIG 6
FIG 7

PIP CAP ASSEMBLY FOR A FIRE PROTECTION SPRINKLER

FIELD

The present disclosure relates to a pip cap assembly for a fire protection sprinkler.

BACKGROUND

This section provides background information related to the present disclosure which is not necessarily prior art.

Automatic sprinklers have long been used to disperse a fluid to control a fire. Typically, the fluid utilized in such systems is water; although systems have also been developed to disburse foam and other materials. Historically, sprinkler assemblies include a solid metal base connected to a pressurized supply of water and a deflector that is used to disperse the water flow. The deflector is typically spaced from the outlet of the base by a frame. A trigger assembly is mounted between the base and a plug, which is positioned over the orifice of the base, to hold the plug in place over the orifice to thereby seal the orifice. When the temperature surrounding the sprinkler assembly is elevated to a temperature associated with a fire condition, the trigger assembly releases the plug and water is allowed to flow from the orifice of the sprinkler assembly.

For proper seating and release, the plug needs to be rigid, corrosion resistant and adapted to engage the trigger assembly in the assembled condition. Typical plugs, commonly referred to as pip caps, have been made from metal such as copper or brass. However, the costs of these materials are rapidly increasing and therefore, a less expensive alternative which is easier to manufacture is desirable. Furthermore, typical plugs have been formed from stampings or, alternatively, they are machined. The cost of a machined pip cap can be generally on the order of ten times greater than a stamped pip cap.

SUMMARY

This section provides a general summary of the disclosure, and is not a comprehensive disclosure of its full scope or all of its features.

According to one form of the present disclosure, a sprinkler assembly includes a sprinkler body having a base and a frame extending from the base. The base has a passage extending therethrough defining an inlet and an outlet. A deflector is mounted to the frame and spaced from the outlet, which is configured to deflect fluid flowing from the outlet in a radial pattern. A trigger assembly extends between the frame and the base and is adapted to support a pip cap assembly in the outlet and release the pip cap assembly when a temperature associated with a fire condition is detected. The pip cap assembly includes a copper shell and a stainless steel insert received in the copper shell and extending outward therefrom. The insertion of the stainless steel insert into the copper shell improves the performance of the pip cap assembly as compared to current cooper pip caps, while minimizing the distance that the stainless steel has to be formed. The angle at the top edge of the insert positions the leading edge of the pip cap perpendicular to the sprinkler frame arm after sprinkler operation. The angle and the harder material of the insert reduces the possibility of the pip cap hanging up on the compression screw.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 3 is a side plan view of the pip cap assembly according to the principles of the present disclosure;

FIG. 4 is a top plan view of the pip cap assembly of FIG. 3;

FIG. 5 is a sectional view taken along line 5-5 of FIG. 4;

FIG. 6 is a top plan view of an insert of the pip cap assembly; and

FIG. 7 is a sectional view of the insert taken along line 7-7 of FIG. 6.

Corresponding reference numerals indicate corresponding parts throughout the several views of the drawings.

DETAILED DESCRIPTION

Figure 1:
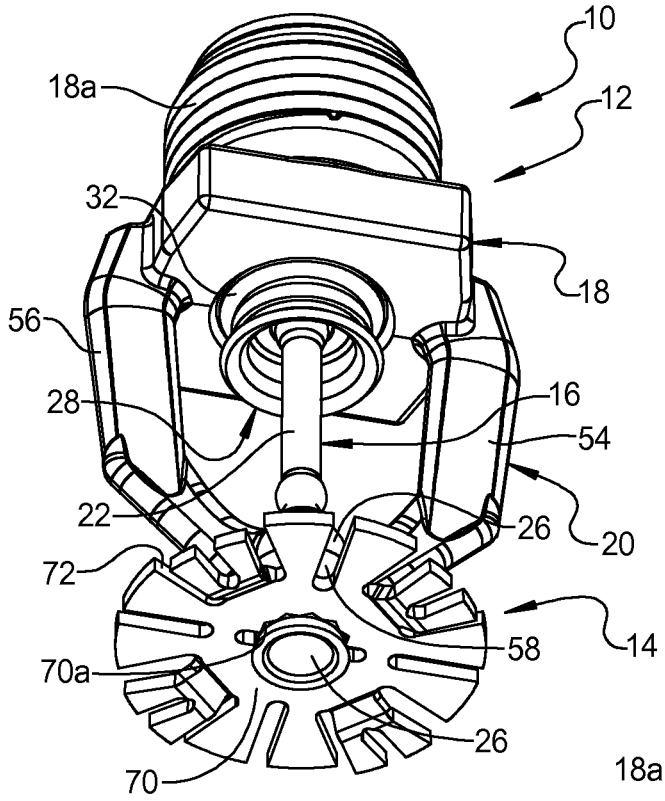
FIG. 1 is a perspective view of a sprinkler assembly of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
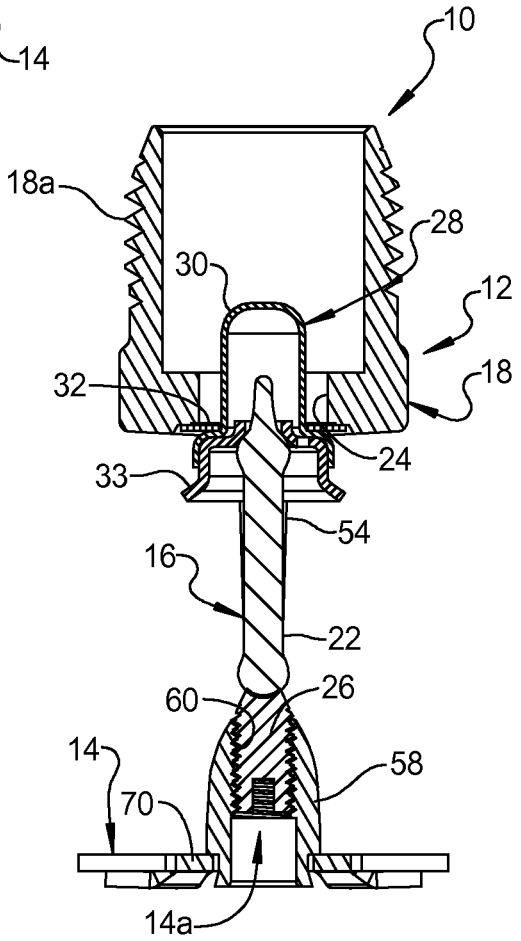
FIG. 2 is a sectional view of the sprinkler assembly of FIG. 1.

Referring to FIGS. 1 and 2, the numeral 10 generally designates a sprinkler assembly of the present disclosure. Sprinkler assembly 10 includes a sprinkler body 12, a deflector 14, and a trigger assembly 16. Body 12 can include a base 18 and a frame 20 to which deflector 14 is mounted. Base 18 can include an externally threaded portion 18*a*, which allows sprinkler body 12 to be threaded onto a fire extinguishing fluid supply line or pipe.

In the illustrated embodiment, trigger assembly 16 includes a frangible bulb 22, which extends between base 18 and frame 20 and which is held in place and further urged toward outlet opening 24 of base 18 by a compression screw 26 to thereby maintain a pip cap assembly 28 in the outlet opening 24, which when opened enables the flow of fire extinguishing fluid through base 18, as will be more fully described below. Alternatively, it should be understood that the trigger assembly 16 can be a fusible linkage type of trigger assembly.

As best seen in FIG. 2, bulb 22 is seated and held in outlet opening 24 by pip cap assembly 28, which in turn urges a ring-shaped or annular spring seal 32 to seal outlet opening 24 under the force of the bulb 22. The pip cap assembly 28 includes a shell 30 and an insert 32 received therein.

With reference to FIG. 5, the shell 30 includes a first generally cylindrical wall 34 having a closed first end 36 and a second end with a radially outwardly extending flange 38 having a transition to an outer axially extending second generally cylindrical wall portion 40. The shell 30 is preferably made from copper although other materials may be suitable. The shell 30 when made from copper can have a wall thickness of approximately 0.02 inches.

The insert 33 includes a generally cylindrical wall portion 42 disposed against the second generally cylindrical wall portion 40 of the copper shell 30. A radially inwardly extending base wall portion 44 is disposed at a first end of the generally cylindrical wall portion 42 and includes an opening 46 therein for accommodating the glass bulb therein. The opening 46 is surrounded by an angled seat surface 47 that is disposed against the glass bulb 22, while a tip of the glass bulb extends through the opening 46. The angled seat surface 47 can be angled relative to the center axis X at an angle $\alpha 1$ of between 35 degrees and 55 degrees and preferably 45 degrees. A second axially extending generally cylindrical portion 48 can extend from the angle seat surface 47. A radially outwardly extending flange portion 49 extends from a second end of the generally cylindrical wall portion 42 and is angularly disposed at an angle $\alpha 2$ of between 45 degrees and 65 degrees, and more preferably about 55 degrees from a center axis X of the insert 32. The base wall portion 44 is disposed against the radially outwardly extending flange 38 of the copper shell 30. The insert 33 is made of a material that is harder than the copper shell 30, such as stainless steel, although other materials can be used. When made from stainless steel, the insert 33 can have a wall thickness of approximately 0.029 to 0.031 inches.

The insert 33 extends from the shell 30 by approximately 25 to 50 percent of its total length. The two piece design positions the stainless steel insert 33 at the edge of the pip cap assembly 28. This provides improved performance by resisting deformation of the pip cap 28 as the harder insert 33 impacts the sprinkler frame 20 after sprinkler activation. The insertion of the stainless steel insert 33 into the copper shell 30 improves the performance of the pip cap assembly as compared to current cooper pip caps, while minimizing the distance that the stainless steel has to be formed. The angle $\alpha 2$ of approximately 55 degrees at the top edge positions the leading edge of the pip cap perpendicular to the sprinkler frame arm after sprinkler operation. The angle reduces the possibility of the pip cap assembly 28 hanging up on the compression screw 26.

Positioned around pip cap assembly 28 is spring seal 32 which is adjacent to the annular rim formed by the outwardly extending flange 38 of the copper shell 30 and which seals the outlet opening 24 when compressed against base 18 by pip cap assembly 28. In an uncompressed state, spring seal 32 can assume a convex configuration. When compressed, however, spring seal 32 has a generally planar configuration (FIG. 2). Spring seal 32 is preferably formed form a spring metal, such as nickel alloy, and, further, is coated with Teflon or Teflon tape, which provides a seal. In this manner, when the compression force is released from spring seal 32, spring seal 32 will return to its convex configuration and generate a force to push pip cap assembly 28 away from outlet opening 24, which reduces the chances of the pip cap assembly 28 interfering with the flow of fire extinguishing fluid from opening 24.

As noted above, deflector 14 is mounted to frame 20. As best seen in FIG. 1, frame 20 can include a pair of frame arms 54 and 56 that extend from base 18. Frame arms 54 and 56 comprise generally L-shaped arms that are joined at their respective ends by a central boss 58. Boss 58 includes an internally threaded aperture or bore 60 (FIG. 2) through which compression screw 26 is threaded to engage and compress bulb 22 against pip cap assembly 28. In order to permit sprinkler body 20 to deliver an appropriate quantity of fire extinguishing fluid during the initial stages of fire development, bulb 22 preferably has a trigger temperature—that is a temperature at which the bulb explodes, typically but not limited to between approximately 145° F. and 165° F.

Referring to FIG. 1, deflector 14 can be formed from a generally planar, circular member 70. Planar member 70 of deflector 14 is formed with a central aperture 70*a*, such as a double hex opening, to attach deflector 14 to boss 58.

To disperse the fire extinguishing fluid in the desired spray pattern, a plurality of spaced slots 72 can be formed at the perimeter of member 70, which extend into member 70 from its outer perimeter edge. The slots are preferably designed and arranged to provide a desired spray pattern.

Sprinkler assembly 10 can be configured to have a discharge coefficient or "K value" (which is the measurement of the flow of water in gallons per minute through the sprinkler head divided by the square-root of the water pressure delivered to the sprinkler in pounds per square inch gauge) for a particular desired application. Discharge coefficient or K factor of a sprinkler is determined by flow testing. For example, the flow testing in increments of pressure from an initial pressure measurement and then decreased in the same increments back to the original pressure value. The K value then is determined from the actual flow in gallons per minute divided by the square-root of the pressure of the supplied water and psig at each increment, which are then averaged from all the incremental values which determines the K factor of the sprinkler.

The response time of a sprinkler is referred to as "RTI", which is a measure of thermal-sensitivity of a sprinkler. RTI is the product of the thermal time constant of the trigger in units of seconds times the square-root of the velocity of the gas across the trigger. Sprinkler assembly 10 can have a desired RTI for any particular application.

Sprinkler 10 may be installed as a pendent or an upright sprinkler, and could also be a concealed sprinkler with a cover assembly mounted over the deflector and over frame 20 of sprinkler assembly 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sprinkler assembly, comprising:

a body having a base and a frame extending from the base, said base having a passage extending therethrough and defining an inlet and an outlet;

a deflector mounted to said frame and spaced from the outlet;

a pip cap assembly for a fire protection sprinkler including a shell having a first generally cylindrical wall having a closed first end and a second end with a radially outwardly extending flange having a transition to an outer axially extending second generally cylindrical wall portion, and an insert having a generally cylindrical wall portion parallel with and disposed against said second generally cylindrical wall portion of said shell, a radially inwardly extending base wall portion at a first end of said generally cylindrical wall portion and a radially outwardly extending flange portion at a second end of said generally cylindrical wall portion and extending axially away from said shell, said base wall portion being disposed against said radially outwardly extending flange of said shell, said insert being made of a material that is harder than said shell;

an annular spring seal surrounding said pip cap assembly and engaging a seat surface of said body surrounding said outlet; and a heat sensitive trigger extending between said frame and said pip cap assembly.

2. The sprinkler assembly according to claim 1, wherein said flange portion extends at an angle from said second end of said generally cylindrical wall portion of said insert at an angle of between 45 degrees and 65 degrees from a center axis of said insert.

3. The sprinkler assembly according to claim 1, wherein said shell is made from copper and said insert is made from stainless steel.

4. The sprinkler assembly according to claim 3, wherein said flange portion extends at an angle from said second end of said generally cylindrical wall portion of said insert at an angle of between 45 degrees and 65 degrees from a center axis of said insert.

5. A pip cap assembly for a fire protection sprinkler, comprising:

a shell having a first generally cylindrical wall having a closed first end and a second end with a radially outwardly extending flange having a transition to an outer axially extending second generally cylindrical wall portion, and an insert having a generally cylindrical wall portion parallel with and disposed against said second generally cylindrical wall portion of said shell, a radially inwardly extending base wall portion at a first end of said generally cylindrical wall portion and a radially outwardly extending flange portion at a second end of said generally cylindrical wall portion and extending axially away from said shell, said base wall portion being disposed against said radially outwardly extending flange of said shell, said insert being made of a material that is harder than said shell.

6. The pip cap assembly according to claim 5, wherein said shell is made from copper and said insert is made from stainless steel.

7. The sprinkler assembly according to claim 6, wherein said flange portion extends at an angle from said second end of said generally cylindrical wall portion of said insert at an angle of between 45 degrees and 65 degrees from a center axis of said insert.

8. The sprinkler assembly according to claim 5, wherein said flange portion extends at an angle from said second end of said generally cylindrical wall portion of said insert at an angle of between 45 degrees and 65 degrees from a center axis of said insert.

* * * * *

UNITED STATES PATENT AND TRADEMARK OFFICE

CERTIFICATE OF CORRECTION

PATENT NO. : 9,265,981 B2
APPLICATION NO. : 13/711992
DATED : February 23, 2016
INVENTOR(S) : Shawn G. Orr et al.

It is certified that error appears in the above-identified patent and that said Letters Patent is hereby corrected as shown below:

In the specification

At column 3, line number 55, delete "32" and insert --33-- therefor.

At column 4, line number 14, delete "32" and insert --33-- therefor.

At column 4, line number 59, delete "20" and insert --12-- therefor.

Signed and Sealed this
Seventeenth Day of May, 2016

Michelle K. Lee

Michelle K. Lee
*Director of the United States Patent and Trademark Office*